US006196313B1

(12) United States Patent
Simons

(10) Patent No.: US 6,196,313 B1
(45) Date of Patent: Mar. 6, 2001

(54) METHOD AND APPARATUS FOR HYDROCARBON PRODUCTION AND RESERVOIR WATER DISPOSAL

(76) Inventor: Horst Simons, Box 14, Site 33, RR12, Calgary AB (CA), T3E 6W3

( * ) Notice: Subject to any disclaimer, the term of this patent is extended or adjusted under 35 U.S.C. 154(b) by 0 days.

(21) Appl. No.: 09/021,384

(22) Filed: Feb. 10, 1998

(30) Foreign Application Priority Data

Feb. 12, 1997 (CA) ..... 2197377

(51) Int. Cl.[7] ..... E21B 43/40
(52) U.S. Cl. ..... 166/266; 166/370; 166/371
(58) Field of Search ..... 166/371, 369, 166/370, 266, 265, 373, 306

(56) References Cited

U.S. PATENT DOCUMENTS

| | | | | |
|---|---|---|---|---|
| 3,363,692 | * | 1/1968 | Bishop | 166/306 |
| 4,139,463 | * | 2/1979 | Murphy et al. | 210/73 |
| 4,241,787 | | 12/1980 | Price . | |
| 4,649,994 | * | 3/1987 | Chaudot | 166/68 |
| 4,805,697 | | 2/1989 | Fouillot et al. . | |
| 4,934,450 | * | 6/1990 | Dice et al. | 166/75.1 |
| 5,296,153 | | 3/1994 | Peachy . | |

OTHER PUBLICATIONS

A.K. Wojtanowicz, H. Xu Downhole Water Loop—A New Completion Method to Minimize Oil Well Production Watercut in Bottom–water–drive Reservoirs The Journal of Canadian Petroleum Technology—Oct. 1995, vol. 34, No. 8 Canada.

* cited by examiner

*Primary Examiner*—David Bagnell
*Assistant Examiner*—Zakiya Walker
(74) *Attorney, Agent, or Firm*—Ronald G. Bitner

(57) ABSTRACT

A system for hydrocarbon production and water disposal utilizing a displacement liquid having a specific gravity less than that of water and immiscible with water. One embodiment of the apparatus comprises an outer well casing having an inlet for reservoir fluid, an outlet for water disposal, and an outlet for produced hydrocarbon fluid; and a tube disposed within the casing having an upper passageway for connection with a supply of a displacement liquid and an inlet having a one-way valve for allowing entry of reservoir fluid from within the casing, and a lower outlet having a one-way valve for allowing egress of water. One embodiment incorporates a downhole separator to allow a higher production rate.

4 Claims, 3 Drawing Sheets

METHOD AND APPARATUS FOR HYDROCARBON PRODUCTION AND RESERVOIR WATER DISPOSAL

BACKGROUND OF THE INVENTION

1. Field of the Invention

This invention relates to hydrocarbon production and reservoir water disposal.

2. Description of the Prior Art

Various methods have been used or proposed for the production of hydrocarbons. The most common method of oil removal involves the use of pumps in which mechanical equipment is placed in the well. Other approaches which have limited application involve gas lift or gas displacement techniques. However, gas displacement techniques are suitable only for shallow wells.

Many oil wells, particularly in the latter stages of the producing life of a well, produce large quantities of salt water. Handling this water represents significant expense in withdrawal, separation and disposal. Various methods have been employed for extracting the oil from the unwanted water. In most cases the total yield is pumped to the surface of the well and various methods used for separating the oil from the water. The unwanted water is pumped downwardly again into a disposal stratum through a disposal well.

A common problem associated with the presence of water is water coning caused by pressure gradients associated with the flow of reservoir fluids, particularly at high production rates. This can lead to premature abandonment of the well.

Some prior proposals have approached the problem of water coning by pumping water back into the formation. One example of such proposals is described in U.S. Pat. No. 4,241,787 E. H. Price. The system described utilized conventional downhole pumps and separator for oil production and water disposal.

More recently a "Downhole Water Loop—A New Completion Method to Minimize Oil Well Production Watercut in Bottom-water-drive Reservoirs" was proposed by A. K. Wojtanowicz and published by The Journal of Canadian Petroleum Technology. The water loop method contemplates a second set of perforations below the original oil water interfaces. Production of water from the lower perforations would reduce or eliminate water coning.

Another example is U.S. Pat. No. 5,296,153 to B. R. Peachey in which is proposed a "Method and Apparatus for Reducing the Amount of Formation Water in Oil Recovered from an Oil Well". This patent proposes using a hydrocyclone separator which separates water and oil in the wellbore. The fluids are pumped using downhole electric motor and pumps. Water is disposed of into a lower formation with oil and some water produced to the surface. This method of dealing with higher water production has limited application due to high costs inherent in the design and method of operation.

A similar approach is proposed in U.S. Pat. No. 4,805,697 to C. Fouillout, "Method of Pumping Hydrocarbons with an Aqueous Phase and Installation for the Carrying out of the Method" in which a static separator is used which works on a similar principle as the hydrocyclone separator. Again implementation and operation of this method appear costly with limited application.

SUMMARY OF THE INVENTION

An object of the present invention is to provide a method and/or apparatus that provides both hydrocarbon production and water disposal and which eliminates or reduces the need for downhole pumping equipment.

Another object is to provide a method for the production of oil or gas that can be economically applied to existing high water cut wells to extend the producing life of these wells and thereby increase the ultimate recovery of hydrocarbons.

It has been found that hydrocarbons can be effectively pumped and water disposed by means of a displacement pump that utilizes a liquid having a density less than water.

The present invention provides a method of producing hydrocarbons and disposing of water from a hydrocarbon and water containing reservoir comprising: providing a casing having an inlet for communicating with the reservoir, an outlet communicating with a water disposal zone, and an outlet for hydrocarbon production; providing a tube within the casing having an upper passageway for connection with a supply of a displacement liquid having a specific gravity less than that of water, an inlet having a one-way valve for allowing entry of reservoir fluid from within the casing, a lower outlet having a one-way valve for allowing egress of water and defining an annular cavity for segregation of hydrocarbons and water, and alternately injecting and withdrawing displacement liquid into the tube at a rate that allows substantial segregation of hydrocarbons and water, whereby upon injecting displacement liquid into the tube, water is forced to the water disposal zone and hydrocarbons exit at the outlet for hydrocarbon production, and upon withdrawal of displacement liquid from the tube, reservoir fluid is drawn into the casing.

The present invention also provides an apparatus for hydrocarbon production and water disposal comprising: an outer well casing having an inlet for reservoir fluid, an outlet for water disposal and an outlet for produced hydrocarbon fluid; a tube disposed within the casing, said tube having an upper passageway for connection with a supply of a displacement liquid having a specific gravity less than that of water, an inlet having a one-way valve for allowing entry of reservoir fluid from within the casing, and a lower outlet having a one-way valve for allowing egress of water, and means for alternately injecting and withdrawing the displacement liquid into the tube.

DESCRIPTION OF THE PREFERRED EMBODIMENTS

Figure 1:
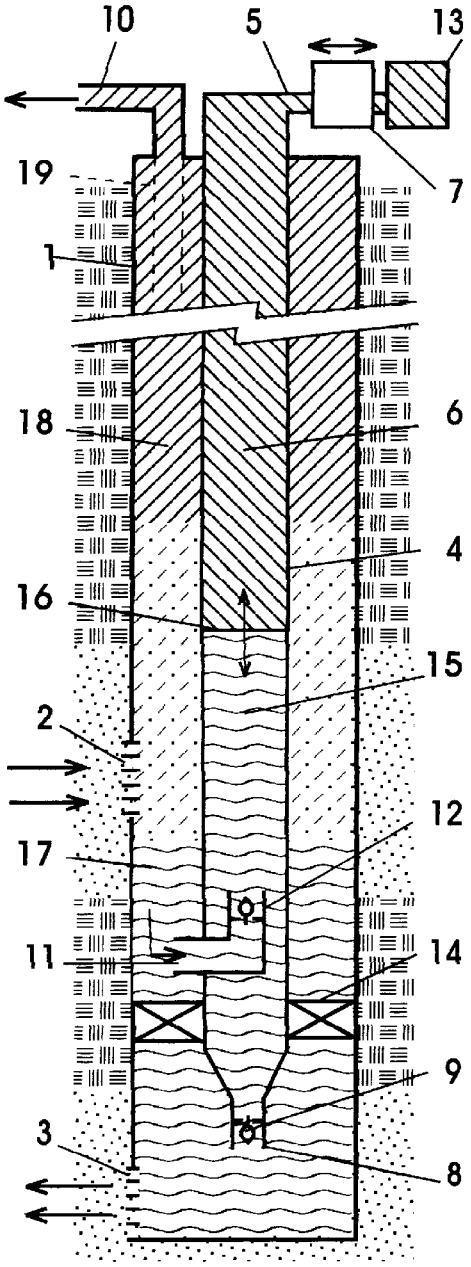
FIG. 1 is a schematic sectional representation of one embodiment of the invention.

FIG. 1 illustrates one embodiment of the invention which is specifically suited for use where the reservoir pressure is high.

With reference to FIG. 1, the apparatus comprises a casing 1 having an inlet 2 for reservoir fluid, a lower outlet 3 for water disposal, and an outlet 10 for hydrocarbon fluid. Disposed within the casing 1 is a tube 4 having an upper inlet/outlet 5 for a displacement fluid 6, a lower outlet 8 having a one-way valve 9 allowing egress of water, and an intermediate inlet 11 having a one-way valve 12 positioned at a low region of the casing 1 to allow entry of segregated water from within the casing 1. The tube 4 and casing 1 define an annulus which is sealed at its lower end by a suitable packing 14. The displacement fluid 6 is alternately injected into, and withdrawn from, the tube 4, by means of a suitable pump 7, and upon withdrawal is stored in a suitable reservoir 13.

The outlet 3 may be positioned to inject water to a lower formation, as shown in FIG. 1, or to a lower region of the producing formation.

The displacement fluid 6 is a liquid having a specific gravity less than that of water and is immiscible with water in order to maintain separation of the fluids. Preferred fluids suitable for the present invention are liquefied propane or butane. Other fluids may be used provided thy have the above properties and can be operated in the liquid state by maintaining sufficient pressure, such as pentane.

In operation, reservoir fluid enters the casing 1, via inlet 2, where hydrocarbons and water segregate, with lower density hydrocarbon such as oil 18 rising and higher density water 17 falling. Injection of displacement fluid 6 into the tube 4, by means of pump 7, forces accumulated water 17 from the tube 4 into the disposal zone via outlets 8 and 3. Withdrawal of displacement fluid 6 draws reservoir fluid into the casing 1, via inlet 2, and segregated water 17 from the casing into the tube 4 via the inlet 11. The one-way valve 12 prevents egress of water from the tube 4 during the injection phase of the cycle, and check valve 9 prevents return of water from the disposal zone. The rate at which water can be pumped from tube 4 to the disposal zone is limited to the inflow rate that allows segregation of hydrocarbons 18 and water 17 in the casing 1. This arrangement reduces or eliminates the production of water to the surface, thereby reducing the cost of treating.

It will be noted that the displacement fluid 6 is in contact with water 15 which due to a density difference remains separate from and below the displacement fluid 6 and defines a water-fluid interface 16 which falls and rises with the injection and withdrawal, respectively, of displacement fluid. The quantity of displacement fluid 6 injected and withdrawn from the tube 4 is selected such that the water-fluid interface 16 remains within the tube 4.

In this embodiment hydrocarbons 18 can be produced at outlet 10 using reservoir pressure. If reservoir pressure is not sufficient for hydrocarbon flow from outlet 10, a conventional pump may be added utilizing a second tubing string 19 inserted into the casing 1.

Figure 2:
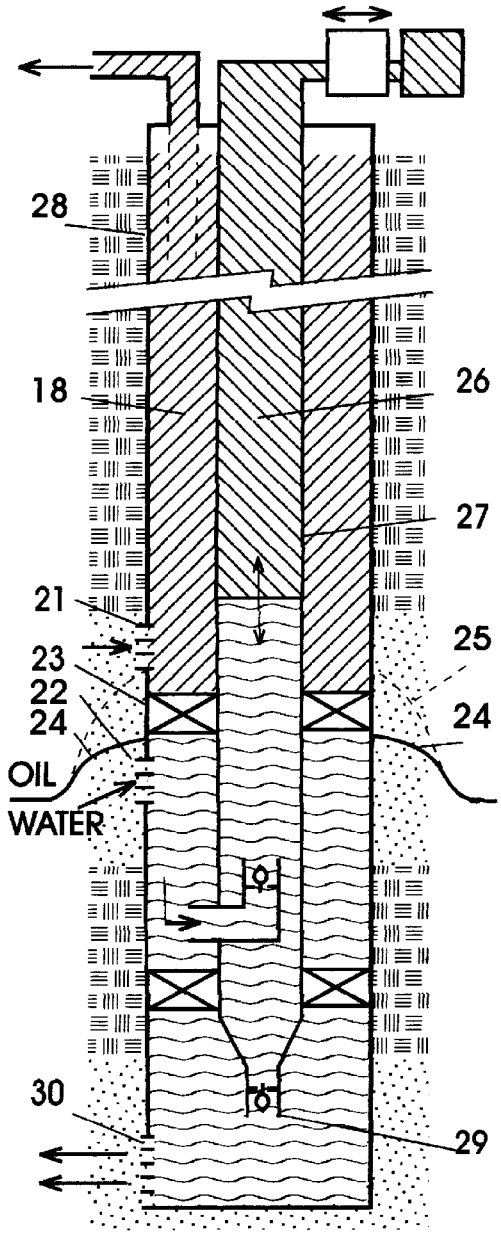
FIG. 2 is a schematic sectional representation of another embodiment of the invention adapted for control of water conning.

FIG. 2 illustrates an embodiment to provide water coning control. This embodiment includes two sets of perforations 21 and 22 separated by packing 23. The lower perforation 22 is placed below the cone-shaped oil-water interface 24 created by the flow of fluid into the upper perforation 21. Operation is similar to that of FIG. 1 in that it involves the cyclical injection of displacement fluid 26 into and withdrawal from the tubing 27. Operation differs from that of FIG. 1 in that separation of oil and water occurs in the reservoir rather than in the casing 28. Hence, only water is produced through the lower set of perforations which is reinjected into the disposal zone via outlets 29 and 30 when displacement fluid 26 is injected. This arrangement reduces the water coning effect which might otherwise extend to a higher level shown as 25.

Figure 3:
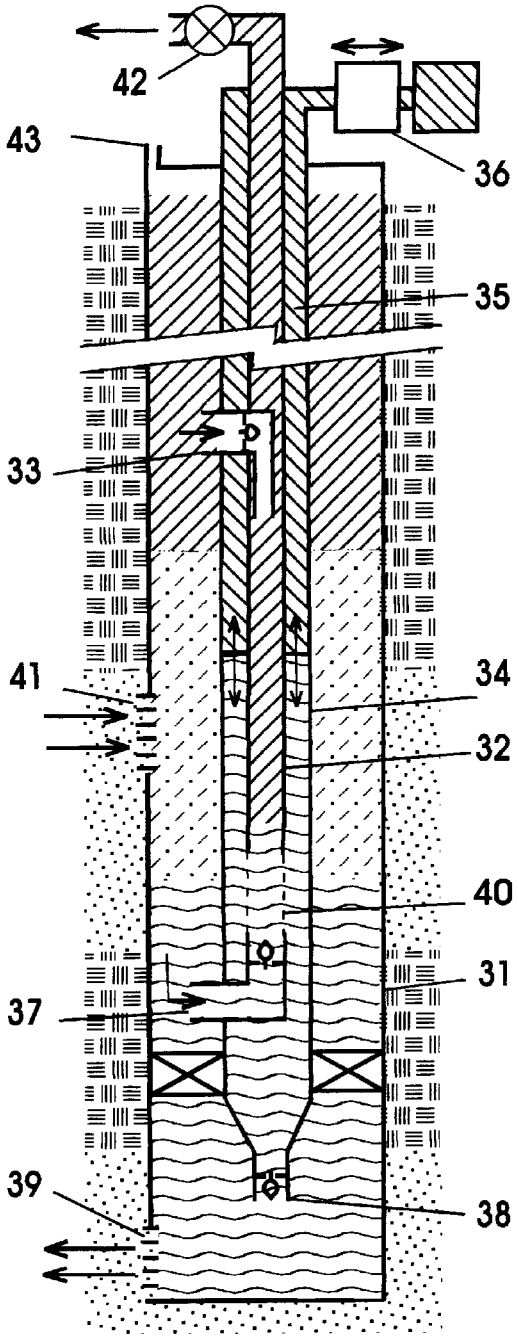
FIG. 3 is a schematic sectional representation of another embodiment of the invention.

The embodiment of FIG. 3 is adapted for use where the reservoir pressure is not sufficient for hydrocarbons to flow up the casing. As in the embodiment of FIG. 1, the embodiment of FIG. 3 includes a casing 31 with inlet 41 for reservoir fluid, a tube 34, a pump 36 to supply displacement fluid 35, outlets 38 and 39 for water disposal, and a vent 43. Disposed within tube 34 is a conduit 32 with an upper inlet 33 with check valve for oil passage, a lower inlet 37 with check valve for water inlet, and an intermediate perforated portion 40. The use of two inlets 33 and 37 reduces flow velocity in the casing to facilitate oil-water separation.

In operation, injection of displacement fluid 35, by means of pump 36, into the tube 34 forces accumulated water from the tube 34 into the disposal zone, via outlets 38 and 39, and forces segregated hydrocarbon fluid upward into conduit 32 for production, while withdrawal of displacement fluid 35 draws reservoir fluid into the casing and segregated hydrocarbons and water from casing 31 into the conduit 32 and tube 34 via the inlets 33 and 37, respectively. The valve 42, and/or a check valve, may be used to prevent back flow when the working fluid is withdrawn.

Figure 4:
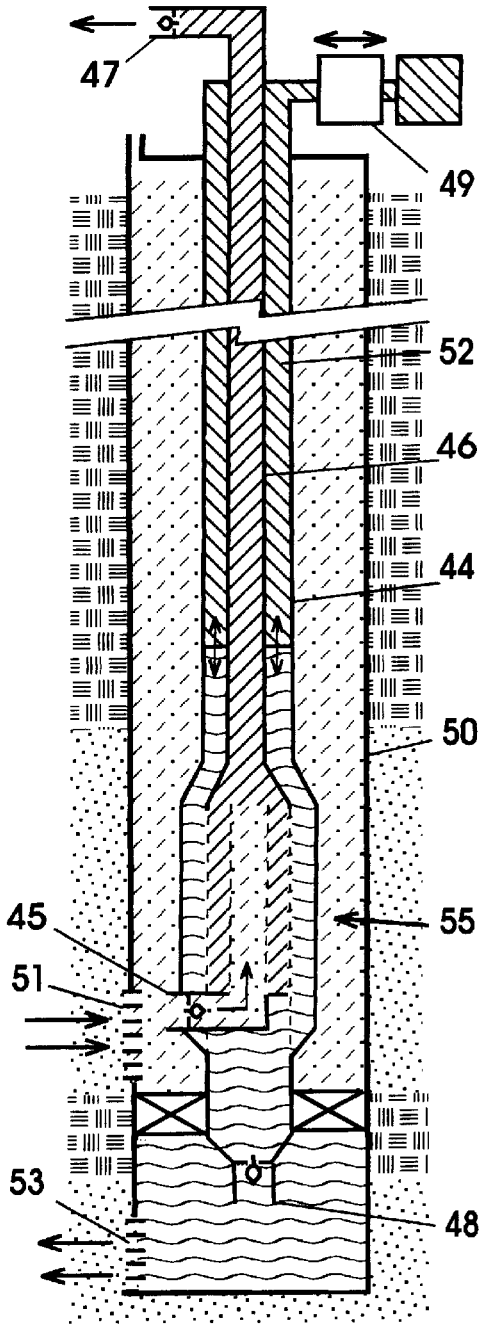
FIG. 4 is a schematic sectional representation of another embodiment of the invention that includes a downhole separator.

The embodiment of FIG. 4 utilizes a downhole separator 55 to facilitate oil-water separation and allows handling relatively high volumes of reservoir fluid for higher production rates. As in the embodiment of FIG. 3, the embodiment of FIG. 4 includes a casing 50 with inlet 51 for receiving reservoir fluid, a tube 44, inlet 45 with check valve for receiving water, an inner conduit 46 with outlet 47 with check valve for hydrocarbon production, outlet 48 with check valve for water disposal, a pump 49 to supply displacement fluid 52 to the tube 44, and a casing outlet 53 for water disposal. The separator 55 interconnects lower ends of tube 44 and conduit 46. Details of the separator are illustrated in FIGS. 5 and 6, and operation is described below.

Operation for production is similar to that of FIG. 2. Injection of a displacement fluid 52, with pump 49, into the tube 44 forces accumulated water into the disposal zone, via outlets 48 and 53 and separated hydrocarbons up through conduit 46, while withdrawal of displacement fluid draws reservoir fluid, via inlet 51, into the casing 50 and water from the casing into the separator 55, via inlet 45.

Figure 5:
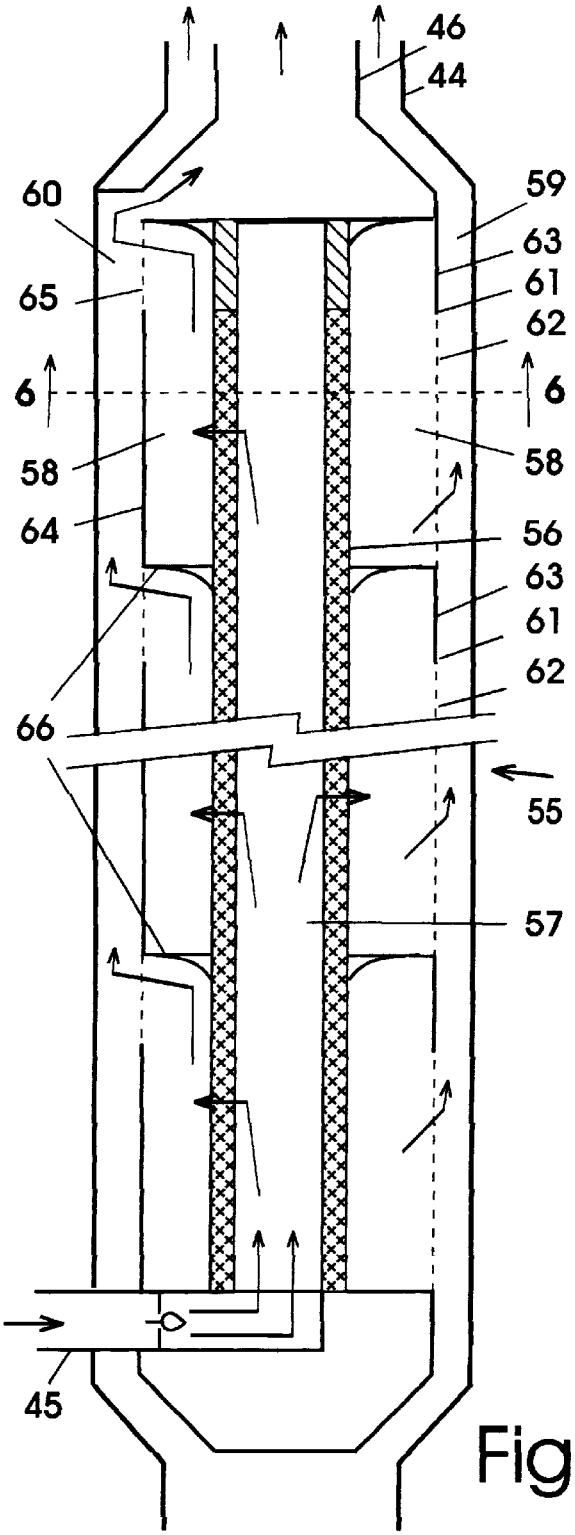
FIG. 5 is an enlarged schematic sectional view of an embodiment of a downhole separator suitable for the present invention.
Figure 6:
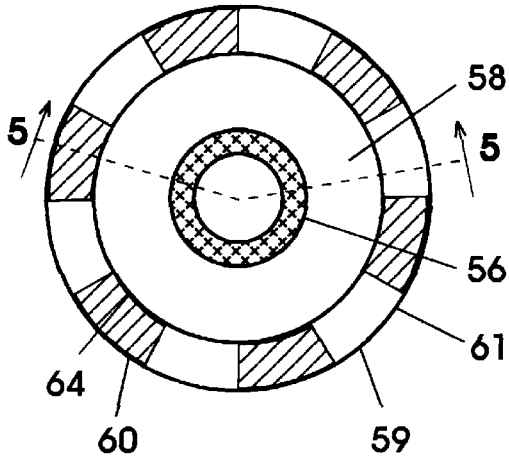
FIG. 6 is a sectional view of the separator taken at 5—5 of FIG. 5.

Referring to FIGS. 5 and 6, the separator 55 comprises an inner cylindrical tube 56, comprising a coalescing material, and defines a central channel 57, surrounded by a separating annulus 58 and a pluarity of circumferentially arranged and alternately spaced water channels 59 and oil channels 60. The water channels 59 communicate with the separating channel 58 by a perforated wall 61, preferably having progressively smaller sized openings 62 from bottom to top, and including an upper closed portion 63. The oil channels 60 communicate with the separating annulus 58 by a wall 64 having an upper opening 65 to allow entry into the oil passage 60. FIG. 5 shows 3 stages for the separator separated from one another by divider 66, but the number of stages could be larger.

The separator converts high velocity vertical flow of reservoir fluid to low velocity horizontal flow to provide the time necessary for the segregation of oil and water. The fluid entering the central channel 57 is forced to flow horizontally through the coalescing material 56 into the separation annulus 58. Uniform low velocity horizontal flow is facilitated by progressively decreasing, from bottom to top, the size of openings 62 in the water receiving channel wall 61.

The coalescing material 56, which may be made of waven materials, such as steel or synthetic fiber, allows passage of water and converts oil emulsified with water into oil droplets. Oil is initially trapped in the material until a critical oil saturation is reached. Oil droplets then migrate to the outside surface where they float upward in the separation annulus 58.

In operation, upon withdrawal of displacement fluid, as described with reference to FIG. 4, reservoir fluid is drawn into the central channel 57 and through the coalescing material 56. As described above, the coalescing material 56 separates the oil into droplets which rise, due to their lower density, within the annulus 58 to be collected in the oil channels 60, via the openings 65, while water flows outwardly to the outer water channels 59 via perforations 62.

As described above with reference to FIG. 4, water is disposed via outlets 48 and 53 and hydrocarbons produced via outlet 47, by the cyclical injection and withdrawal of displacement fluid 52, which is also similar to the operation of the embodiments of FIGS. 1 to 3.

It will be understood that the invention is not limited to the embodiments described above. For example, other embodiments may include the separation of natural gas and water with the same intent of disposing the water into a lower formation or a lower part of the same formation, while allowing the gas flow to the surface. Also, separation devices other than the gravity oil/water separator described herein may be used in conjunction with the present invention. It will be understood that the embodiments which are illustrated schematically herein may additionally include a conventional "well head" to which the casing and tubing is connected at the surface.

What is claimed is:

1. A method of producing liquid hydrocarbons and disposing of water from a hydrocarbon and water containing reservoir comprising:

providing a casing having an inlet for communicating with the reservoir, an outlet communicating with a water disposal zone, and an outlet for hydrocarbon production;

providing a tube within the casing having an upper passageway for connection with a supply of a displacement liquid having a specific gravity less than that of water, an inlet having a one-way valve for allowing entry of reservoir fluid from within the casing, a lower outlet having a one-way valve for allowing egress of water and defining an annular cavity for segregation of hydrocarbons and water; and alternately injection and withdrawing displacement liquid into the tube at a rate that allows substantial segregation of hydrocarbons and water, whereby upon injection displacement liquid into the tube, water is forced to the water disposal zone and hydrocarbons exit at the outlet for hydrocarbon production, and upon withdrawal of displacement liquid from the tube, reservoir fluid is drawn into the casing.

2. The method of claim 1, including providing a conduit disposed within the casing having an inlet for receiving separated hydrocarbons and an outlet for egress of the hydrocarbons.

3. The method of claim 1, including providing a downhole separator interconnecting the tube and conduit for facilitating the segregation of hydrocarbons and water.

4. An apparatus for liquid hydrocarbon production and water disposal comprising:

an outer well casing having an inlet for reservoir fluid, an outlet for water disposal and an outlet for produced hydrocarbon fluid;

a tube disposed within the casing, said tube having an upper passageway for connection with a supply of a displacement liquid having a specific gravity less than that of water, an inlet having a one-way valve for allowing entry of reservoir fluid from within the casing, and a lower outlet having a one-way valve for allowing egress of water;

means for alternately injecting and withdrawing the displacement liquid into the tube;

a conduit disposed within the casing, said conduit having an inlet for receiving separated hydrocarbons and an outlet for egress of the hydrocarbons;

a separator interconnecting the tube and conduit, said separator comprising an inner permeable wall of coalescing material for separating oil droplets from reservoir fluid and an outer perforated wall for receiving water, wherein the perforated wall has openings of progressively increasing size from top to bottom to provide uniformity of horizontal fluid flow.

* * * * *